US009696074B2

(12) United States Patent
Ceccarelli et al.

(10) Patent No.: US 9,696,074 B2
(45) Date of Patent: Jul. 4, 2017

(54) CONTROLLING REFRIGERATION COMPRESSION SYSTEMS

(71) Applicant: WOODWARD, INC., Fort Collins, CO (US)

(72) Inventors: Nicola Ceccarelli, Hoofddorp (NL); Jean Philippe Monge, Haarlem (NL); Alex Benim, Katy, TX (US)

(73) Assignee: Woodward, Inc., Fort Collins, CO (US)

( * ) Notice: Subject to any disclaimer, the term of this patent is extended or adjusted under 35 U.S.C. 154(b) by 689 days.

(21) Appl. No.: 14/147,325

(22) Filed: Jan. 3, 2014

(65) Prior Publication Data

US 2015/0192336 A1 Jul. 9, 2015

(51) Int. Cl.

| | |
|---|---|
| ***F25B 9/00*** | (2006.01) |
| ***F25B 1/00*** | (2006.01) |
| ***F25B 39/04*** | (2006.01) |
| ***F25B 41/04*** | (2006.01) |
| ***F25B 31/00*** | (2006.01) |

(Continued)

(52) U.S. Cl.

CPC ..... *F25B 49/02* (2013.01); *F25B 1/10* (2013.01); *F25B 49/022* (2013.01); *F25B 41/043* (2013.01); *F25B 2500/08* (2013.01); *F25B 2700/21151* (2013.01); *F25B 2700/21152* (2013.01)

(58) Field of Classification Search

CPC ..... F25B 1/10; F25B 2500/08; F25B 2700/21151; F25B 2700/21152; F25B 49/02; F25B 49/022

USPC ..... 62/505, 184, 510, 87, 222, 115

See application file for complete search history.

(56) References Cited

U.S. PATENT DOCUMENTS 4,660,384 A * 4/1987 Pallanch ..... F25B 47/022 62/151
5,094,085 A * 3/1992 Irino ..... F04C 18/3564 236/1 EA (Continued)

FOREIGN PATENT DOCUMENTS

CN 100516717 7/2009
CN 102494426 6/2012

(Continued)

OTHER PUBLICATIONS

PCT International Search Report and Written Opinion of the International Searching Authority, PCT/US2014/071966, Apr. 23, 2015, 12 pages.

(Continued)

*Primary Examiner* — Henry Crenshaw
(74) *Attorney, Agent, or Firm* — Fish & Richardson P.C.

(57) ABSTRACT

A refrigerant compression system and method for controlling a refrigerant compression system are described. In some aspects, the refrigerant compression system includes a compressor system having a plurality of compression stages, a plurality of quench valves, a first suction temperature control circuit associated with a first quench valve, a second suction temperature control circuit associated a second quench valve, and a discharge temperature control circuit associated with a plurality of the quench valves. Quench valve settings are determined based on evaluation of one or more outputs from the suction temperature control circuits and the discharge temperature control circuit.

20 Claims, 6 Drawing Sheets

(51) Int. Cl.
*F25B 1/10* (2006.01)
*F25B 49/02* (2006.01)

(56) References Cited

U.S. PATENT DOCUMENTS 5,103,652 A * 4/1992 Mizuno ..... F04C 29/042 418/55.6
5,477,697 A * 12/1995 Wharton ..... F25B 7/00 62/117
5,499,509 A * 3/1996 Harold ..... F04D 29/5846 415/119
5,557,091 A * 9/1996 Krummel ..... G06K 7/1443 235/462.08
5,950,443 A * 9/1999 Meyer ..... F04C 28/00 417/292
6,332,336 B1 12/2001 Mirsky et al.
8,360,744 B2 1/2013 Mirsky et al.
2003/0010046 A1 1/2003 Freund et al.
2003/0019221 A1* 1/2003 Rossi ..... F25B 49/005 62/127
2003/0159452 A1* 8/2003 Ben Yahia ..... F25B 9/008 62/222
2004/0018096 A1* 1/2004 Lifson ..... F04B 49/10 417/53
2007/0140889 A1* 6/2007 Chen ..... F04D 29/441 418/183
2008/0078192 A1* 4/2008 Ignatiev ..... F25B 1/10 62/184
2008/0078203 A1* 4/2008 Duraisamy ..... F25B 1/10 62/510
2008/0170948 A1 7/2008 Martinez et al.
2008/0210768 A1* 9/2008 You ..... F24H 4/02 237/2 B
2008/0236184 A1* 10/2008 Morozumi ..... F04C 18/3442 62/324.6
2008/0264080 A1 10/2008 Creed et al.
2009/0183517 A1* 7/2009 Ino ..... F25B 31/008 62/87
2009/0188265 A1* 7/2009 Ko ..... F25B 13/00 62/222
2010/0058783 A1* 3/2010 Lifson ..... F25B 9/06 62/115
2010/0199694 A1* 8/2010 Taras ..... F25B 1/10 62/117
2011/0168377 A1 7/2011 Alers et al.
2012/0192580 A1 8/2012 Santos

FOREIGN PATENT DOCUMENTS

DE 3716393 11/1987
JP 2012159260 8/2012
RU 57398 10/2006
WO WO2010/036480 A2 4/2010

OTHER PUBLICATIONS

PCT International Preliminary Report on Patentability, PCT/US2014/071966, Jul. 14, 2016, 10 pages.
"Expertise Beyond Controls Quench Control", Compressor Controls Corporation, Published in 2013, http://www.cccglobal.com/sites/default/files/documents/CCC_QuenchBrochure_4-13.pdf, 6 pages.
Al-Shahrani et al., "Start-Up Experience for Value Recovery from CCR Net Gas at Yanbu Refinery", Copyright 2007, 12 pages.
TRI-SEN—Tri-Sen Turbomachinery Controls, "Refrigeration Systems", Jun. 8, 2012, 5 pages.
Wikipedia, the free encyclopedia, "Vapor-Compression Refrigeration", http://en.wikipedia.org/wiki/Vapor-compression_refrigeration, Published on or before Dec. 20, 2013, 11 pages.

* cited by examiner

CONTROLLING REFRIGERATION COMPRESSION SYSTEMS

BACKGROUND

This specification relates to controlling refrigeration compression systems.

A compressor is a machine which increases the pressure of a compressible fluid, e.g., a gas, through the use of mechanical energy, for instance. Compressors are used in industrial processes in various commercial and industrial applications, for example, in refrigeration, air-conditioning, pipeline, petrochemical, and other applications. Refrigeration compressors (or refrigerant compressors) can be used in refrigeration compression systems to help move heat in refrigeration cycles (or refrigerant cycles). For example, a vapor-compression refrigeration cycle can include feeding a circulating refrigerant (e.g., Freon) into a compressor as a vapor. The vapor is compressed at the compressor and exits the compressor superheated. The superheated vapor travels through a condenser that can cool and remove the superheat and then condense the vapor into a liquid by removing additional heat. The liquid refrigerant goes through, for example, an expansion valve (also called a throttle valve) where its pressure abruptly decreases, causing flash evaporation and auto-refrigeration of, typically, less than half of the liquid. That can result in a mixture of liquid and vapor at a lower temperature and pressure. The cold liquid-vapor mixture then travels through the evaporator coil or tubes and is vaporized by cooling the warm air (from the space being refrigerated) being blown by a fan across evaporator coil or tubes. The resulting refrigerant vapor returns to the compressor inlet to complete the thermodynamic cycle.

SUMMARY

In some aspects, a refrigerant compression system includes a compressor system having a plurality of compression stages, a first quench valve operable to provide an adjustable flow of quench fluid into a first compression stage, and a second quench valve operable to provide an adjustable flow of quench fluid into a second compression stage. The refrigerant compression system also includes a first suction temperature control circuit associated with the first quench valve, a second suction temperature control circuit associated with the second quench valve, and a discharge temperature control circuit. The first suction temperature control circuit is operable to identify a first temperature setpoint and an inlet temperature of the first compression stage, and determine a first quench flow demand of a quench fluid flow that is injected through the first quench valve into the first compression stage based on the first temperature setpoint and the inlet temperature of the first compression stage. The second suction temperature control circuit is operable to identify a second temperature setpoint and an inlet temperature of the second compression stage, and determine a second quench flow demand of a quench fluid flow that is injected through the second quench valve into the second compression stage based on the second temperature setpoint and the inlet temperature of the second compression stage. The discharge temperature control circuit is operable to receive information regarding a discharge temperature at an outlet of the plurality of compression stages and a discharge temperature setpoint, and determine a third quench flow demand of the quench fluid flow that is injected through the second quench valve into the second compression stage and a fourth quench flow demand of the quench fluid flow that is injected through the second quench valve into the second compression stage such that the discharge temperature at the outlet of the plurality of compression stages is maintained at or below the discharge temperature setpoint. The refrigerant compression system further includes a first quench valve controller associated with the first quench valve and a second quench valve controller associated with the second quench valve. The first quench valve controller is operable to receive the first quench flow demand determined by the first suction temperature control circuit, receive the third quench flow demand determined by the discharge temperature control circuit, and determine a valve position demand of the first quench valve based on the first quench flow demand and the third quench flow demand. The second quench valve controller is operable to receive the second quench flow demand determined by the second suction temperature control circuit, receive the fourth quench flow demand determined by the discharge temperature control circuit, and determine a valve position demand of the second quench valve based on the second quench flow demand and the fourth quench flow demand.

The details of one or more implementations are set forth in the accompanying drawings and the description below. Other features, objects, and advantages will be apparent from the description and drawings, and from the claims.

DETAILED DESCRIPTION

Figure 1:
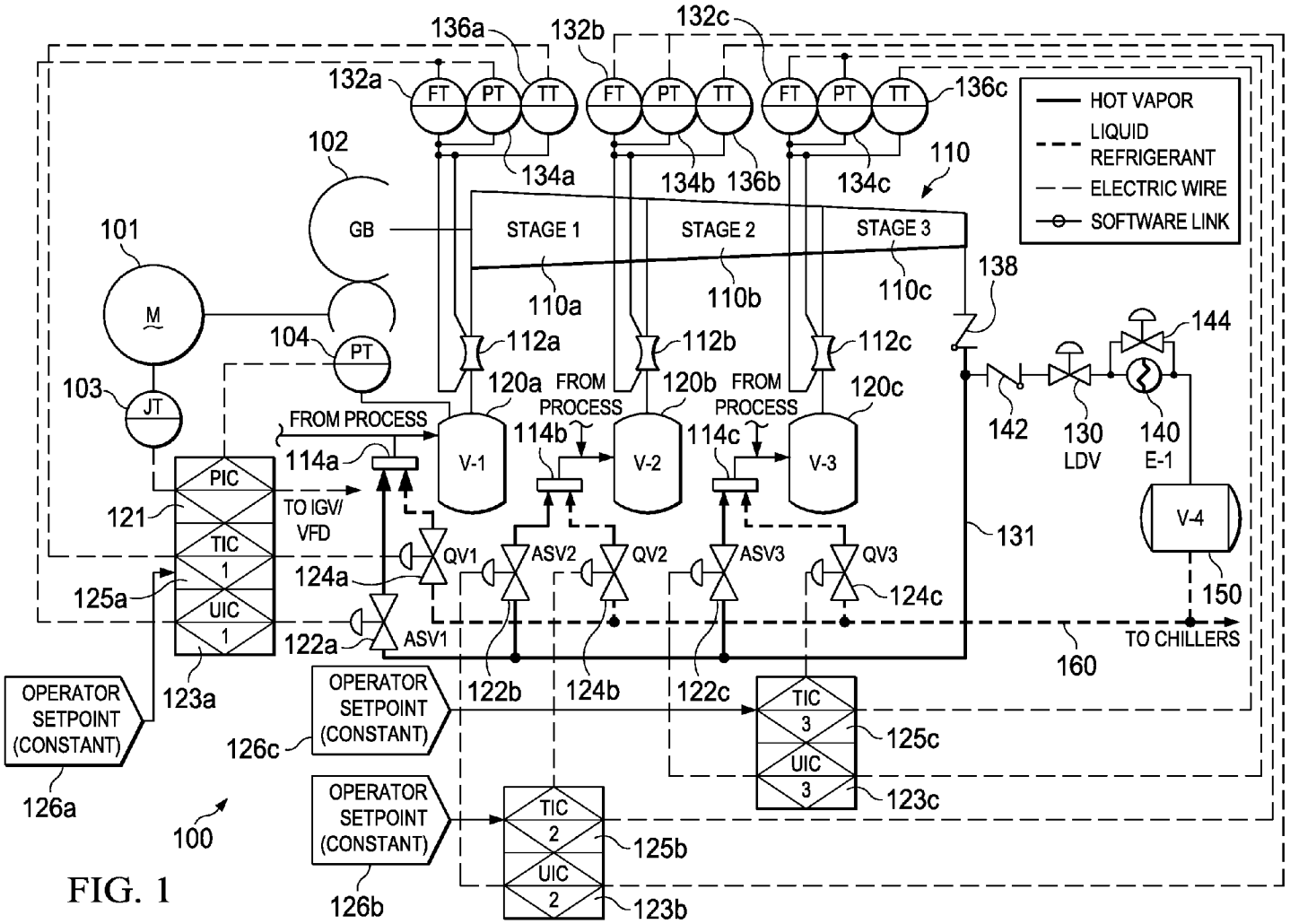
FIG. 1 is a schematic diagram of an example refrigeration compression system.

Some systems (e.g., air-conditioning systems, refrigerators, industrial systems such as oil refineries, petrochemical and chemical processing plants, and natural gas processing plants, etc.) include one or more refrigeration compressor systems (e.g., vapor-compression refrigeration systems). As an example application, a propane refrigeration compressor (PRC) can be used in a recovery of Natural Gas Liquids (NGL) process that includes several gas processing stages during which the raw natural gas extracted from the gas wells is purified, dehydrated, and finally cooled to liquefy heavier hydrocarbons, yielding lean pipeline grade natural gas (residue gas). A PRC can be used to pre-cool the stream of natural gas before it enters a cryogenic turbo-expander for full NGL separation. Proper operation of the PRC can be critical for maximizing NGL product yield, a major economic indicator of NGL recovery production. Other applications include, for example, liquefaction of natural gas (LNG) and Liquefied Petroleum Gas (LPG) recovery.

In some instances, a closed loop refrigeration compression system (or refrigerant compression system) can include evaporative chillers, at least a single case centrifugal compressor with one or more of an inlet, suction scrubber(s), economizer(s), anti-surge recycle valve(s), liquid refrigerant quench valve(s), de-super heater, condenser, liquid refrigerant letdown/level control valve, or other components. The refrigerant system can include multiple compression stages. Multiple anti-surge valves can be used to recycle fluid flow (e.g., hot vapor refrigerant) into one or more compression stages. In addition, multiple quench valves can be used to provide quench fluid flow (e.g., liquid refrigerant) into the compression stages to prevent overheating. Effective and stable control of the anti-surge valves and quench valves is desirable for balancing the recycle fluid flow and the quench fluid flow and for achieving efficient and stable operation of the overall refrigeration compression systems.

Conventional control techniques sometimes do not provide fully automated stable operation of the refrigerant compression systems, for example, due to inadequate control of liquid refrigerant quench valves and anti-surge valves during the startup. These limitations often force plant operators to put some or all control valves under manual control. Manual operation of multiple valves, however, may cause bigger issues. For example, it may lead to misbalance among positions of multiple control valves and result in prime mover overload (e.g., due to excessive quenching or over quenching), overflowing suction scrubbers with liquid refrigerant (e.g., excessive quenching), and compressor surging (e.g., due to insufficient compressor total flow), with consequent compressor trips and process downtime costing hundreds of thousands and millions of dollars to the plant owners.

The example systems and techniques described in this disclosure can help resolve one or more of the above-mentioned problems. For example, one or more suction temperature control circuits (or loops) and a discharge temperature control circuit (or loop) can be introduced into a multi-stage refrigeration compression system. Each of the two types of temperature control circuits can generate a quench flow demand for a compression stage. A quench valve controller can be used to determine an ultimate quench flow demand for the compression stage based on the outputs from the suction temperature control circuit and the discharge temperature control circuit.

The suction temperature control circuit can be used to maintain a unique or same suction temperature setpoint at the inlet of each of the multiple compression stages. In some implementations, the suction temperature control circuit can use an adaptive setpoint based on the refrigerant's actual dew temperature, compensated for suction pressure, rather than fixing the setpoint to be a constant. The suction temperature control circuit can help prevent overheating while avoid over-quenching for each compression stage.

The discharge temperature control circuit can be used to limit the compressor discharge temperature to be at or below, for example, a discharge temperature high trip limit. In some instances, a single discharge temperature control circuit can achieve fully automatic and coordinated control of multiple quench valves. The discharge temperature control circuit can help optimize positions of the quench valves relative to positions of their respective recycle valves, and help determine minimum or otherwise desirable quench flow demand for each compression stage.

In some implementations, the larger of the quench flow demand determined by the suction temperature control circuit and the quench flow demand determined by the discharge temperature control circuit can be selected, by the quench valve controller, as the ultimate quench flow demand for a compression stage. The quench valve controller can convert the ultimate quench flow demand into a corresponding valve position demand of the associated quench valve for the compression stage. The valve position demand can be a desirable or demanded valve position of a quench valve determined such that the quench valve can adjust its position to the demanded valve position to allow the quench flow of the ultimate flow demand injected through the quench valve into the compression stage. As a result, in some instances, a minimized or optimal cooling requirement of the compression stages, and a minimized load to the entire refrigeration compression system, can be achieved.

The example systems and techniques described herein can be effectively applied, for example, to refrigeration compression systems during system startup, normal operation and/or shutdown. In some implementations, the example systems and techniques can achieve one or more of several advantages. For instance, the example systems and techniques can help improve safety and availability of the equipment and reduce downtime by designing a method that controls the complex refrigerant compressor loops in fully automatic mode. The example systems and techniques can help avoid operation mistakes and unnecessary compressor trips (e.g., scrubber high level trip, prime mover overload trip, etc.). In some instances, the example systems and techniques can facilitate a sustained operation during process transients with adequate balance of recycle flows and quench flows that minimizes cooling requirement of the recycle gas and minimizes the load of the entire refrigeration compression system. In some aspects, the systems and techniques described herein can provide improved efficiency, reliability, control stability, or a combination of these and other benefits for the refrigeration compression system. Additional or different advantages may be obtained in some applications.

Although this disclosure discusses propane refrigeration compressors as examples, the systems and techniques described herein can be effectively applied to refrigeration compression systems with other types of refrigerants. The systems and techniques described herein can be adapted based on properties of the considered refrigerant (e.g., the refrigerant's dew temperature curve) without departing from the scope of the disclosure.

FIG. 1 is a schematic diagram of an example refrigeration compression system 100. The example refrigeration compression system 100 includes a 3-stage compressor 110 (with stages 1-3 denoted as 110*a-c*, respectively), three suction scrubber V1-V3 (i.e., Stage 1 suction scrubber V-1 120*a*, Stage 2 suction scrubber V-2 120*b*, Stage 3 suction scrubber V-3 120*c*), a letdown valve LDV-1130, a de-superheater (air cooler) E-1 140, an accumulator V-4 that includes a condenser, a chiller (not shown), and one or more transmitters, valves, and controllers. For example, the example refrigeration compression system 100 can include one or more flow elements (e.g., flow transmitters 132*a-c*) that indicate a property (e.g., quantity, velocity, rate, etc.) of flow, one or more pressure meters (e.g., pressure transmitters 104 and 134*a-c*), one or more temperature sensors/transmitters (e.g. temperature transmitters 136*a-c*), or another kind of measurement equipment. Depending on the piping design and other considerations, the location of each flow element may be different from as shown in FIG. 1. The example refrigeration compression system 100 can also include one or more of an inlet or suction valve, a recycle valve, an anti-surge valve (e.g., ASV1 120*a*, ASV2 120*b*, and ASV3 120*c*), a quench valve (e.g., QV-1 124*a*, QV-2 124*b*, and QV-3 124*c*), or other control mechanisms (e.g., a speed governor, an inlet guide vane). The components can be placed and configured in various manners as needed.

The example compressor 110 is driven by an electric motor 101 through a gear box (GB) 102. In some instances, gas turbines, steam turbines, or other types of prime mover or motor can power the compressor 110. A refrigeration compression system may include fewer or more compression stages. In some implementations, instead of a single multi-stage compressor, the refrigeration compression system can include multiple single-stage (or multi-stage) compressors connected in series, which can also form a compressor system with multiple compression stages. The refrigeration compression system may include additional or different components and may be configured in another manner.

As an example process, propane vapors or any other type of vapors from the process chillers (not shown) can enter the compressor stage 1 110*a*. The propane vapors can be compressed in the 1$^{st}$ stage 110*a*, mixed with a sideload from a medium pressure economizer (not shown), compressed in 2$^{nd}$ stage 110*b*, mixed with sideload from a high pressure economizer (not shown), and compressed in 3$^{rd}$ stage 110*c*. The compressed vapors can exit compressor 110 and be throttled by the letdown valve LDV-1 130 to a pressure needed for normal operation of the de-superheater E-1 140 with condensed refrigerant accumulating in the condenser of the accumulator V-4 150. The condensed refrigerant can be sent to main chillers (not shown) where it vaporizes and returns to the compression cycle (e.g., entering from suction scrubbers V-1 to V-3 120*a-c*).

Typically, to protect the compressor 110 from surge each of the compressor stages 110*a-c* can be equipped with an anti-surge recycle valve (e.g., ASV1 120*a*, ASV2 120*b*, and ASV3 120*c*). Before compressor startup, each ASV is usually fully open, and when compressor 110 is started the refrigerant discharge temperature increases due to compression and hot vapors can be recycled back to a compressor stage suction (e.g., at suction scrubbers V-1 to V-3 120*a-c*). As hot vaporous refrigerant is recycled, the suction temperatures (e.g., measured by the temperature transmitters (TTs) 104, 136*a-c*) tend to rise due to the lack of cooling along the recycle path (e.g., as indicated by the hot vapor paths 131). Continuous temperature build-up in the compressor loop can result in reaching equipment high temperature limits and consequent shutdown of the unit. To prevent an overheating situation as described above, the refrigeration compression system 100 is equipped with quench valves QV-1 124*a*, QV-2 124*b*, and QV-3 124*c* for each compressor stage, respectively. The quench valves can adjust suction temperature of the respective compressor stages by injecting liquid refrigerant from the condenser receiver V-4 150 into the streams of hot recycle gas. The liquid refrigerant injected through a quench valve can absorb the heat from recycle gas and vaporize (flash) thus producing an overall cooling effect.

In some implementations, the refrigeration compression system 100 can include one or more control circuits (or loops, systems) for controlling, for example, suction pressure, recycling flow, or other conditions or properties of the compression stages. The control circuits can include one or more controllers (e.g., proportional-integral-derivative (PID) controllers) that can control the valves (e.g., ASVs and QVs) and other appropriate components (wires, software modules, etc.). A controller can receive a setpoint and a process variable (e.g., a process temperature, pressure, etc.), and can modulate or otherwise control the positions of an associated valve to adjust the refrigerant flow going through the valve. As an example, the refrigeration compression system 100 includes anti-surge valve controllers UIC-1 123*a*, UIC-2 123*b*, and UIC-3 123*c* associated with the anti-surge valves ASV1 120*a*, ASV1 120*a*, and ASV3 120*c*, respectively. Similarly, each of the quench valves QV-1 124*a*, QV-2 124*b*, and QV-3 124*c* can have a respective quench valve controller TIC-1 125*a*, TIC-2 125*b*, and TIC-3 125*c*. The anti-surge valve controllers and the quench valve controllers can be PID controllers or other types of controllers. In some instances, the compressor stage actual flow rate can be calculated by the respective UIC-1 . . . UIC-n controller from the flow rate of the preceding/following stage and the sidestream flow rate. For example, flow rate of stage 2 can be calculated as a sum of flow rate 112*a* of stage 1 and sidestream flow rate 112*b* of stage 2. In some implementations, the calculation of the stage actual flow may take into account the differences in flowing pressures and temperatures of the composite flow rates and other required measured or calculated variables.

In some implementations, the refrigeration compression system 100 can include a respective suction temperature control circuit for each compression stage. For example, a first suction temperature control circuit can include the controller TIC-1 125*a* that controls the quench valve QV1 of the compression stage 1 110*a*; a second suction temperature control circuit can include the controller TIC-2 125*b* that controls the quench valve QV2 of the compression stage 2 110*b*; and a third suction temperature control circuit can include the quench valve controller TIC-3 125*c* that controls the QV3 of the compression stage 3 110*c*. In response to the control signal received from the controller TIC-1 125*a*, TIC-2 125*b*, and TIC-3 125*c*, the quench valves QV-1 124*a*, QV-2 124*b*, and QV-3 124*c* can partially or fully open or close to adjust the fluid flow of the liquid refrigerant injected into the refrigerant compression cycle. In some implementations, a single suction temperature control circuit can be used to control the multiple quench valves of the multiple compression stages. For example, the first, second and third suction temperature control circuits described above can be integrated, for example, on a single board, and be regarded as a single suction temperature control circuit that controls the suction temperature of multiple compression stages. Additional or different implementations can be configured.

Figure 2:
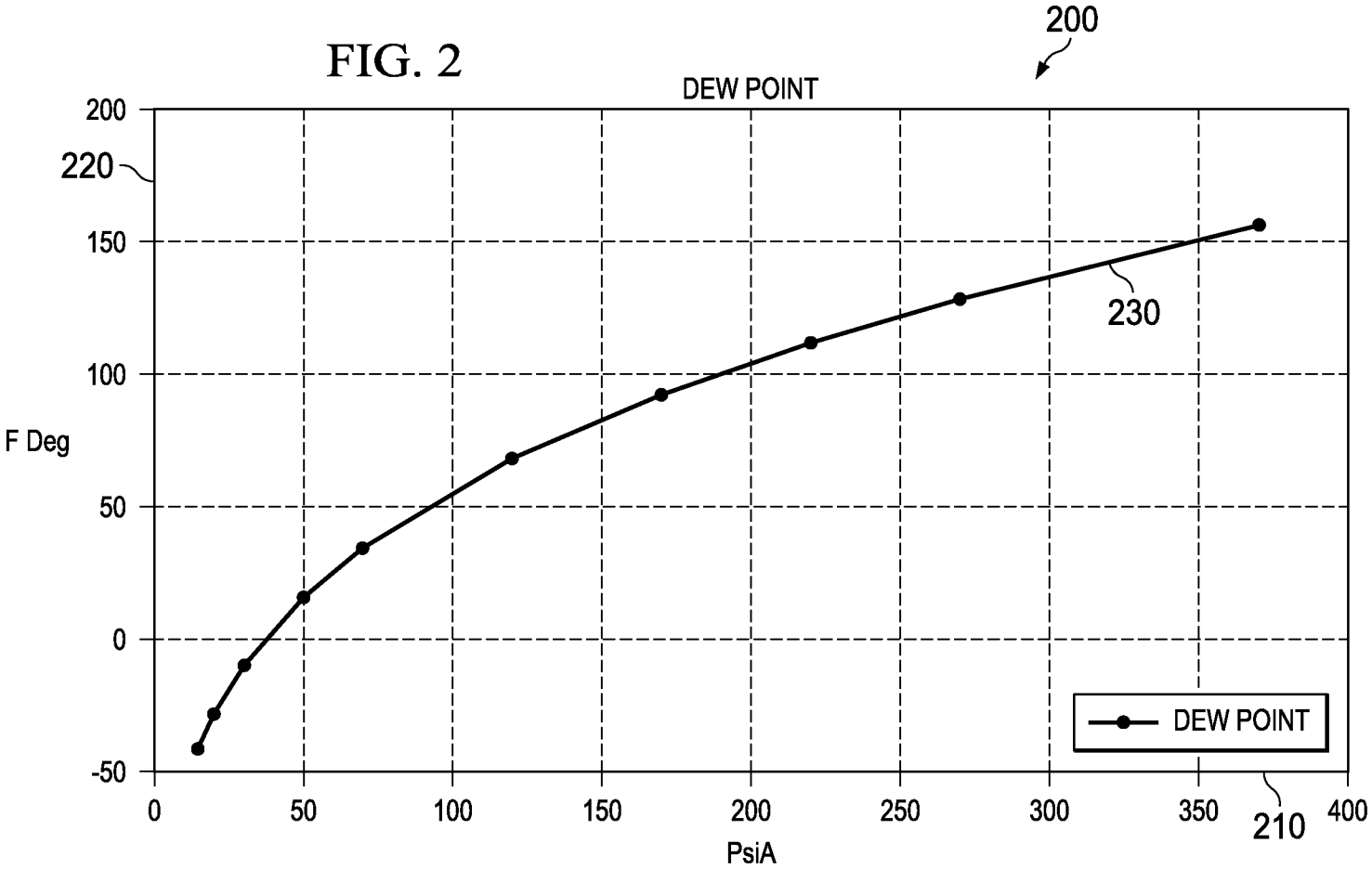
FIG. 2 is a plot illustrating an example propane dew temperature curve.

FIG. 2 is a plot 200 illustrating an example propane dew temperature (dew point) curve 230. Dew point is the temperature below which a vapor at constant barometric pressure condenses into liquid at the same rate at which it evaporates. The dew point can also be referred to as dew temperature or the saturated vapor temperature. The example refrigeration compression system 100 can use propane or other types of refrigerant. The achievable refrigerant temperature of a propane refrigerant system, a two-phase single component refrigeration system, depends on the phase equilibrium pressure. As the vaporizer pressure changes, the resulting temperature varies accordingly. The plot 200 shows example propane dew temperature (e.g., in Fahrenheit (° F.) as shown in the vertical axis 220) with respect to different vaporizer pressures (e.g., in pounds per square inch absolute (psia) as shown in the horizontal axis 210). From the dew temperature curve, the lowest refrigerant temperature that can be physically achieved while maintaining the propane as a gas can be determined given the pressure.

In some implementations, control circuits can modulate quench valves based on a constant temperature setpoint corresponding to, for example, a design pressure close to atmospheric pressure. For example, as shown in FIG. 1, a respective constant setpoint (e.g., 126*a*, 126*b*, and 126*c*) can be set (e.g., by an operator) for the quench valve controller TIC-1 125*a*, TIC-2 125*b*, and TIC-3 125*c* of the refrigeration compression system 100. The constant temperature may work when the compression system 100 achieves a stable condition, for example, during normal operations. During startup, however, the compressor can run at minimum speed/inlet guide vane position while recycling for prolonged periods of time until the process is ready for increasing the chiller load. Suction pressure at such conditions can be much higher than the design pressure and can be determined, in some instances, solely by the recycle flow rate. A controller that attempts to control temperature to a fixed low setpoint in an automatic mode may wind up with its quench valve adjusted to 100% open, which can result in dumping the maximum amount of liquid refrigerant into the suction scrubber. The excess liquid refrigerant can be partially carried away by the vapor stream into the compressor leading to prime mover overload and possible mechanical damage. In addition, liquid refrigerant can flood the suction scrubber and can lead to scrubber high level trip.

In some instances, as the quench valve opens to reduce the recycle gas temperature, the vapor density at a compressor inlet increases, resulting in higher total vapor mass flow through the compressor and the resulting higher power requirement from the prime mover. Such additional power requirement may push the prime mover to exceed its load limit, and overload trips may occur as a result.

Figure 3:
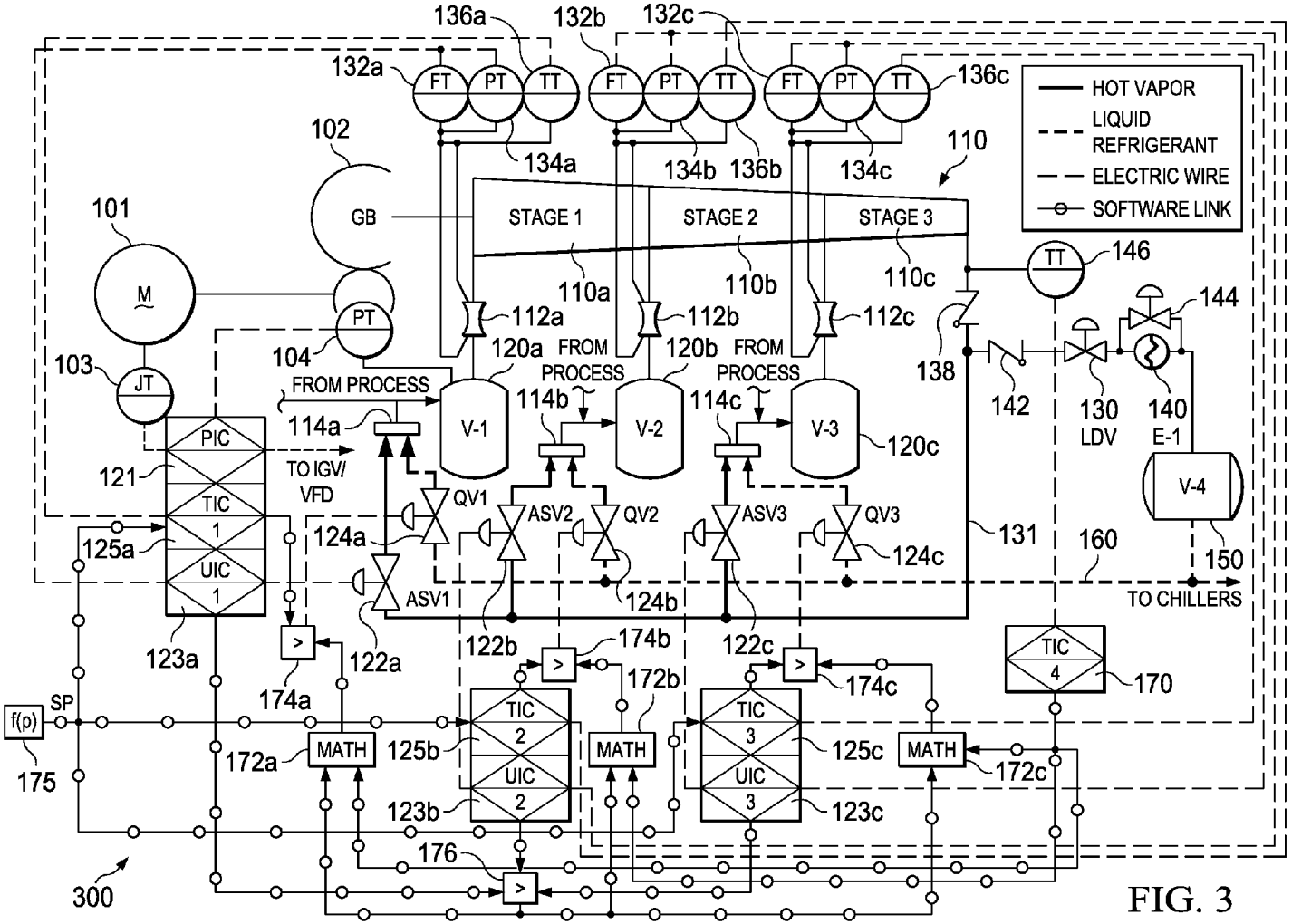
FIG. 3 is a schematic diagram of another example refrigeration compression system.

FIG. 3 is a schematic diagram of another example refrigeration compression system 300. Compared with the components of the example refrigeration compression system 100 in FIG. 1, the example refrigeration compression system 300 includes modified suction temperature control circuits and a discharge temperature control circuit. Also, instead of the controllers TIC-1 125*a*, TIC-2 125*b*, and TIC-3 125*c* directly controlling the quench valves QV-1 124*a*, QV-2 124*b*, and QV-3 124*c*, respectively, additional quench valve controllers 174*a-c* are included for direct control of the positions of quench valves QV-1 124*a*, QV-2 124*b*, and QV-3 124*c*, respectively. The quench valve controllers 174*a-c* can receive outputs from the suction temperature control circuits and the discharge temperature control circuit and determine a quench flow demand for each compression stage based on the outputs. In some implementations, the suction temperature control circuits can be used to avoid over quenching at the inlets of the compression stages, while the discharge temperature control circuit can be used to prevent overheating at the outlet of the compression stages. The suction temperature control circuits and the discharge temperature control circuit can jointly control (e.g., via the controllers 174*a-c*) the multiple interacting quench valves in an automated and coordinated manner.

The refrigeration compression system 300 illustrates an example implementation of automated and coordinated control between multiple recycle and quench valves in a refrigeration compression system. Unlike conventional manual control during startups and normal shutdowns of the refrigeration compression system, the example system and techniques described here can help balance recycle flows and liquid refrigerant flows and allow them to sustain stable operation. Also, the example system and techniques described herein can help solve the problems that can occur under manual operation such as, for example, spurious trips on high temperature (excessive recycling, insufficient quenching), suction scrubber high level trips (excessive scrubber liquids), compressor surge (insufficient vapor flow through the compressor) or motor overload (either excessive recycling or a compressor ingesting liquid refrigerant).

The suction temperature control circuits of the example refrigeration compression system 300 can be used for adaptive suction temperature control with a temperature setpoint based on the refrigerant's actual dew temperature (with suction pressure compensated). In some implementations, the suction temperature control circuits can include one or more controllers (e.g., TIC-1 125*a*, TIC-2 125*b*, and TIC-3 125*c*), a setpoint determination module 175, and other appropriate components. For instance, a first suction temperature control circuit can include the controller TIC-1 125*a* associated with the quench valve QV1 of the compression stage 1 110*a*; a second suction temperature control circuit can include the controller TIC-2 125*b* associated with the quench valve QV2 of the compression stage 2 110*b*; and a third suction temperature control circuit can include the controller TIC-3 125*c* associated with the quench valve QV3 of the compression stage 3 110*c*. In some implementations, a single suction temperature control circuit can be used to control the multiple quench valves of the multiple compression stages. For example, the first, second and third suction temperature control circuits described above can be integrated, for example, on a single board, and be regarded as a single suction temperature control circuit that controls the such temperature of multiple compression stages. Additional or different implementations can be configured.

In some instances, each of the controllers TIC-1 125*a*, TIC-2 125*b*, and TIC-3 125*c* can receive a setpoint from the setpoint determination module 175. Rather than a single constant setpoint corresponding to a fixed pressure (e.g., a design pressure close to atmospheric pressure), the setpoint can be adjusted automatically (adaptively), for example, following the refrigerant's actual dew temperature according to the dew temperature curve (e.g., the propane due temperature curves in FIGS. 2 and 4) and the suction pressure at the compression stages.

Figure 4:
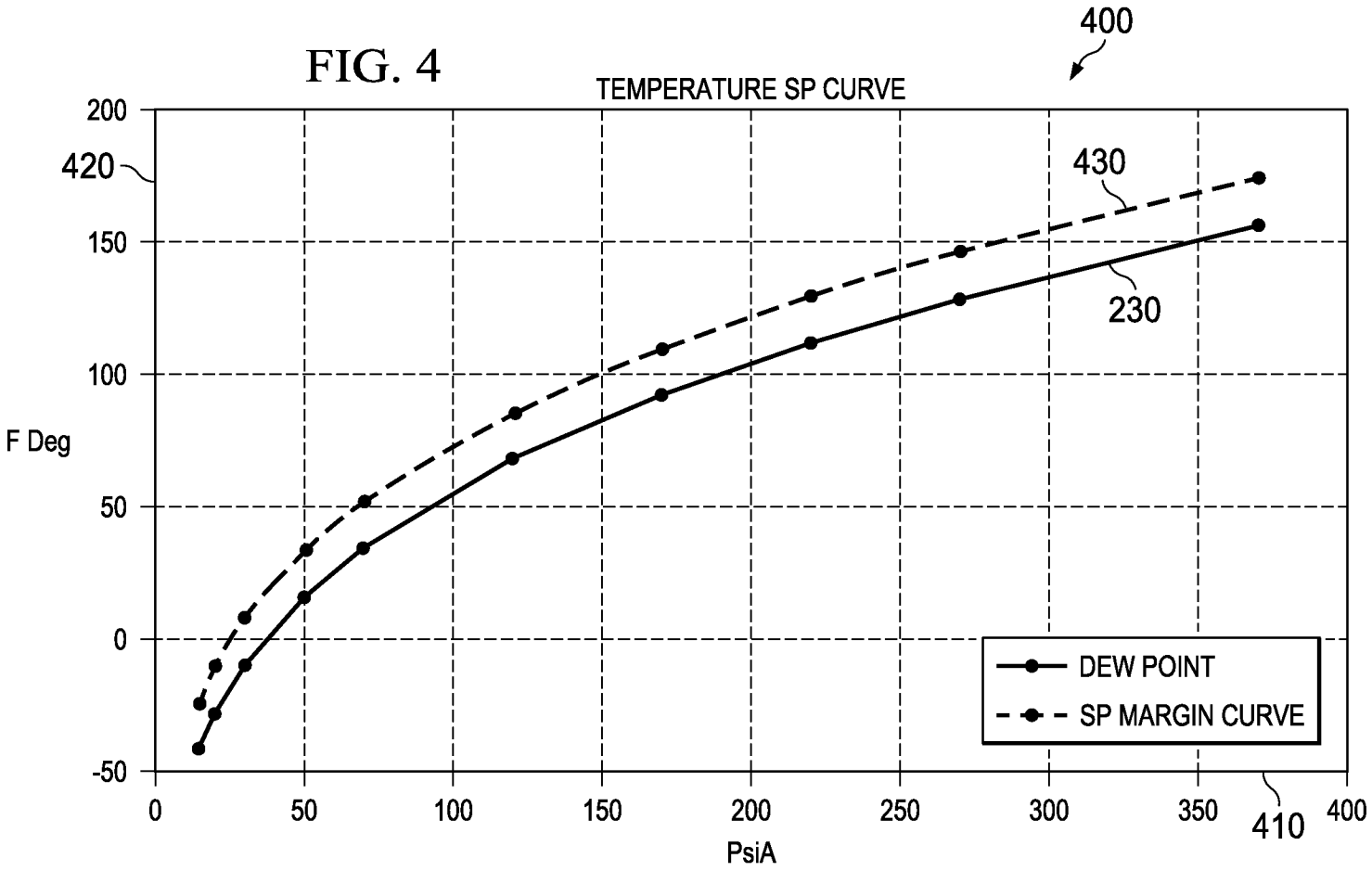
FIG. 4 is a plot illustrating example temperature curves.

FIG. 4 is a plot 400 illustrating example temperature curves 230 and 430 for various vaporizer pressures. The temperature curves 230 and 430 can be used, for example, by the setpoint determination module 175, to determine the temperature setpoint of a controller (e.g., TIC-1 125*a*, TIC-2 125*b*, or TIC-3 125*c*) associated with a quench valve at an inlet of a compression stage. In some implementations, the temperature curve 430 can be a temperature setpoint curve that is obtained by shifting the propane dew temperature curve 230 by a setpoint margin. Given a suction pressure at a compression stage, the corresponding temperature setpoint of the controller can be identified according to the temperature setpoint curve 430. For instance, the multiple compression stages (e.g., stages 110*a-c*) can have different suction pressures, thus different setpoints can be identified and used for the multiple controllers (e.g., TIC-1 125*a*, TIC-2 125*b*, and TIC-3 125*c*) of the suction temperature control circuits of the refrigeration compression system 300.

In some implementations, each of the compression stages can have a respective setpoint margin. The setpoint margins can be the same or different among the multiple compression stages, thus one or more setpoint curves can be determined based on the setpoint margins and the refrigerant's dew temperature curve (e.g., propane's dew point curve 230). In some implementations, the shift (e.g., the setpoint margin) from the dew temperature curve 230 to the temperature setpoint curve 430 can be uniform across the entire considered pressure range (e.g., as shown in horizontal axis 410); or the shift can be pressure-dependent such that the vertical distance between the dew temperature curve 230 to the temperature setpoint curve 430 at one pressure is different than the vertical distance at another pressure. Additional or different approaches can be used, for example, by the setpoint determination module 175 to determine the setpoint curves for the quench valve controllers associated with multiple compression stages.

Figure 5:
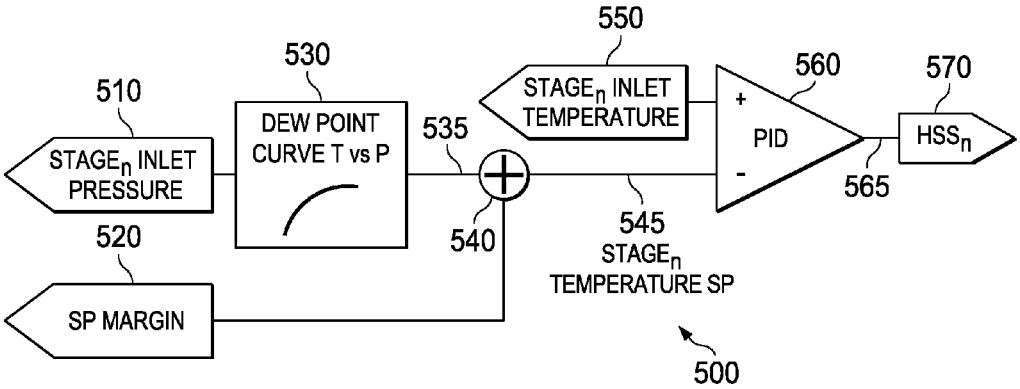
FIG. 5 is a schematic diagram illustrating example function blocks of a suction temperature control circuit.

FIG. 5 is a schematic diagram illustrating example function blocks of a suction temperature control circuit 500. The suction temperature control circuit 500 can be used as one or more of the first, second, or third suction temperature control circuits of the example refrigeration compression system 300 in FIG. 3 (e.g., n=1, 2, 3), or it can be used in other applications. In some implementations, the first, second, or third suction temperature control circuit of the example refrigeration compression system 300 can each include the example suction temperature control circuit 500, a variant thereof, or other types of control circuits. The three suction temperature control circuits can operate concurrently in parallel, in series, or in another manner.

As an example process, the suction temperature control circuit 500 can receive an inlet pressure 510 of a compression stage n and a setpoint margin 520 for determining a temperature setpoint 545 for the compression stage n. The inlet pressure 510 can be obtained, for example, from one or more pressure transmitters (e.g., PT 134*a*, PT 134*b*, or PT 134*c*) associated with the compression stage n. The temperature setpoint 545 can be determined, for example, based on the example techniques described with respect to FIG. 4 or it can be determined in another manner. For instance, given the inlet pressure 510 of the compression stage n, a corresponding dew temperature 535 can be identified according to a dew point curve 530 (e.g., the propane dew temperature curve 230 in FIGS. 2 and 4). The identified dew temperature 535 and the setpoint margin 520 can be added, multiplied, or otherwise manipulated at 540 to obtain the temperature setpoint 545 for the compression stage n. The temperature setpoint 520 can be a configurable offset, for example, determined automatically by the suction temperature control circuit 500, by an operator, or by another entity. The temperature setpoint 520 can be the same or different for different inlet pressures 510 or different compression stages n. In some instances, the example function blocks 510-540 can form the function blocks of the setpoint determination module 175 in FIG. 3. In some implementations, different compression stages, for example, n=1, 2, 3 . . . can share the same function blocks 510-540 (and hence the same hardware or software modules) but with respective inputs and outputs. In other implementations, different compression stages, for example, n=1, 2, 3 . . . can have individual hardware or software modules that perform the operations of the function blocks 510-540. Additional or different implementations can be configured.

The example suction temperature control circuit 500 shown in FIG. 5 includes a PID controller 560. The PID controller can be the example controller TIC-1 125*a*, TIC-2 125*b*, or TIC-3 125*c* in FIG. 3, or another controller. The PID controller 560 can receive or otherwise identify the determined temperature setpoint 545 and an inlet temperature 550 of the compression stage n. The inlet temperature 550, as a process variable of the PID controller 560, can be obtained, for example, from one or more temperature transmitters (e.g., TT 136*a*, TT 136*b*, or TT 136*c*) associated with the compression stage n. Based on the setpoint 545 and the inlet temperature 550, the PID controller 560 can determine a quench flow demand 565 of a quench fluid flow to be injected into the compression stage n for maintaining the suction temperature at the compression stage n at or close to the temperature setpoint 545 without over quenching. The determined quench flow demand 565 can be fed into a controller 570 (e.g., the quench valve controller 174*a*, 174*b*, or 174*c* in FIG. 3) that controls the position of the quench valve of the compression stage n for further processing. In some instances, the controller 570 can include a high signal selector (HSSn) to select a larger quench flow demand between the quench flow demand 565 determined by the suction temperature control circuit 500 and another quench flow demand (e.g., a quench flow demand determined by a discharge temperature control circuit, a quench flow demand determined by an operator, etc.). In some implementations, the suction temperature control circuit 500 can include additional or different function blocks. In some cases, the example process may include the same, additional, fewer, or different operations performed in the same or different manner.

Referring back to FIG. 3, the example refrigeration compression system 300 includes the discharge temperature control circuit that can be used to limit the compressor discharge temperature and achieve fully automatic and coordinated control of multiple quench valves. In some instances, the discharge temperature control circuit can help optimize positions of the quench valves relative to positions of their respective hot vapor recycle valves, and help determine minimum or otherwise desirable quench flow demand for each compression stage.

In the example shown in FIG. 3, the discharge temperature control circuit includes a discharge temperature controller TIC-4 170, math modules 172*a-c*, and other components (e.g., high signal selector (HSS) 176, electric wires, etc.). The discharge temperature control circuit can receive or otherwise identify a discharge temperature high limit and an outlet temperature of the compression stages. In some implementations, the single discharge temperature control circuit can determine quench flow demands for the multiple compression stages such that the discharge temperature at the outlet of the compression stages is maintained at or below the discharge temperature high limit. In some instances, the quench flow demands determined by the discharge temperature control circuit can be passed to the quench valve controllers 174*a-c* that ultimately control the positions of the quench valves QV 124*a-c*. As such, the discharge temperature control circuit can modulate or at least partially control all quench valves QV 124*a-c* simultaneously in order to prevent high temperature trips.

In some implementations, optimum cooling of the compression stage can be achieved when almost the entire the mass of liquid refrigerant injected through the quench valve is vaporized. The amount can be determined, for example, by the recycle flow rate—the main determinant of how much heat can be absorbed by the vaporized liquid. The discharge temperature control circuit can obtain information regarding a recycle flow demand (e.g., from anti-surge controller UIC-1123*a*, UIC-2 123*b*, and UIC-3 123*c*) of each individual compression stage and determine the quench flow demand of each stage proportional to the recycle flow demand of the corresponding compression stage. As such, the discharge temperature control circuit can implement distributive coordinated control to provide minimum (or otherwise desirable) cooling on each stage of compression and optimum or otherwise desirable heat exchange conditions in the de-superheater E-1 140. Example implementations of the discharge temperature control circuit are described in FIG. 6 in more detail. Additional or different implementations can be configured.

Figure 6:
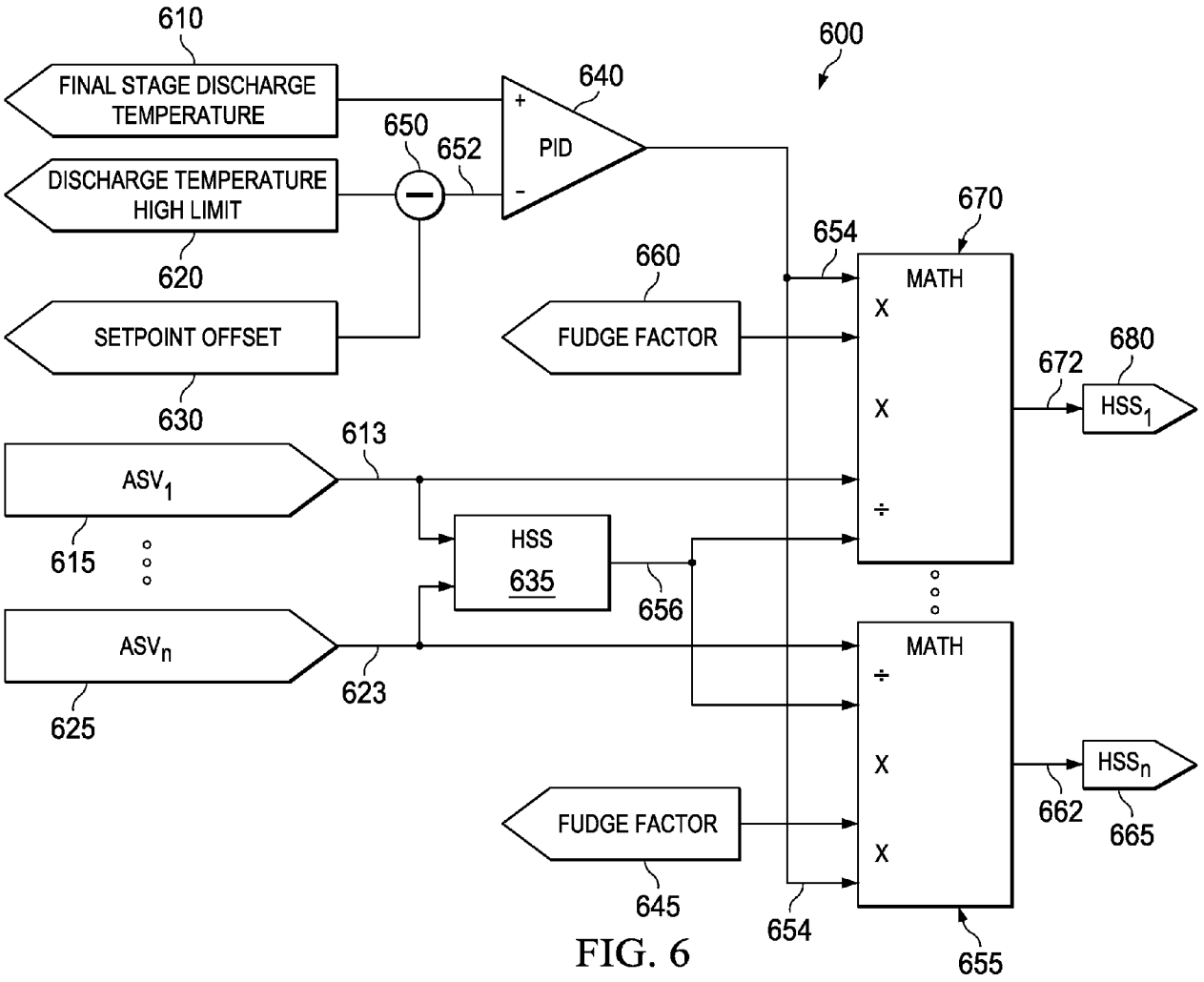
FIG. 6 is a schematic diagram illustrating example function blocks of a discharge temperature control circuit.

FIG. 6 is a schematic diagram illustrating example function blocks of a discharge temperature control circuit 600. The discharge temperature control circuit 600 can be used as the discharge temperature control circuit of the example refrigeration compression system 300 in FIG. 3, or it can be used in other applications. The discharge temperature control circuit 600 includes a PID controller 640, math modules 670 and 655, an HSS 635, and other components. In some implementations, the suction temperature control circuit 500 can include additional or different function blocks or be configured in another manner.

The PID controller 640 can be the example discharge temperature controller TIC-4 170 as shown in FIG. 3, or another controller. The PID controller 640 can receive or otherwise identify information regarding a discharge temperature 610 at an outlet of the plurality of compression stages of the compression stages. The discharge temperature 610 can be, for example, a compressor final discharge temperature, or temperature at the outlet of another compression stage. The discharge temperature 610, as a process variable of the PID controller 640, can be, for example, measured or otherwise monitored by a temperature transmitter (e.g., TT 146 in FIG. 3). The PID controller 640 can also receive or otherwise identify a discharge temperature setpoint 652. The discharge temperature setpoint 652 can be determined, for example, based on a discharge temperature high trip limit 620 and a setpoint offset 630. As an example, the discharge temperature setpoint 652 can be established with the setpoint offset 630 below the high limit 620. The discharge temperature setpoint 652 can be determined in another manner (e.g., the discharge temperature high trip limit 620 scaled or divided by the setpoint offset 630). Based on the discharge temperature setpoint 652 and the measured discharge temperature 610, the PID 640 can determine a quench flow demand 654 such that the amount of the quench flow can help limit the discharge temperature 610 to stay at or below the discharge temperature setpoint 652. In some instances, the quench flow demand 652 can be distributed among the multiple compression stages so that a respective quench flow demand can be determined for each compression stage.

In some implementations, the quench flow demand 652 can be distributed among the multiple compression stages based on their respective recycle flow demands. For example, the quench flow demand can be in proportion to the recycle flow demand for a compression stage. In some instances, such a distribution can help balance the quench flows and recycle flows injected into the compression stages and help achieve optimum cooling of the compression stages. For example, the discharge temperature control circuit 600 can receive or otherwise identify recycle flow demands 613, . . . , 623 for compression stages 1, . . . , n. The recycle flow demands 613, . . . , 623 can be obtained, for example, from the anti-surge valve controllers associated with the compression stages (e.g., UIC-1123*a*, UIC-2 123*b*, and UIC-3 123*c*) or the positions of anti-surge valves ASV1 615, . . . , ASVn 625 (e.g., ASV1 120*a*, ASV1 120*a*, and ASV3 120*c* in FIG. 3). The multiple recycle flow demands 613, . . . , 623 can be compared and a maximum recycle flow demand 656 can be computed by the HSS 635 (e.g., the HSS 176 in FIG. 3). For each compression stage, a ratio of the recycle flow demand (e.g., 613 or 623) to the maximum recycle flow demand 656 can be computed, for example, by the math module 670 or 655, respectively. For example, the math module 670 can be associated with the compression stage 1 where the ratio of the recycle flow demand 613 to the maximum recycle flow demand 656 can be computed. The ratio can be multiplied by the quench flow demand 654 determined by the PID controller 640 and the resulting product can be used to determine the quench flow demand 672 for the compression stage 1. The quench flow demand 662 for the compression stage n can be computed by the math module 655 analogously. Thus, the resulting quench flow of each compression stage is proportional to the stage recycle flow demand relative to the maximum recycle flow demand.

In some implementations, the math modules 670, 655 can be implemented, for example, by software, hardware, or a combination thereof. In some instances, the multiple compression stages can share a single math module or the multiple compression stages can each have an individual math module. In some implementations, instead of the HSS 635, other operations (e.g., a summation, a linear combination, etc.) can be used to compute a reference quench demand (e.g., the denominator of the ratio) that every stage quench demand is compared with. In some implementations, the quench flow demand for each compression stage can be computed in other manners. The computed quench flow demands (e.g., 672, 662) can be the same or different as between the multiple compression stages. The quench flow demands for the multiple compression stages can be computed automatically by the discharge temperature control circuit 600. In some implementations, the computations for the multiple compression stages can be performed simultaneously in parallel, in series, or in another manner.

In some implementations, a fudge factor can be included in computing the quench flow demand for each compression stage. A fudge factor is an ad hoc quantity introduced into a calculation, formula or model, for example, to allow a margin in unknown quantities. The math function blocks 670 and 655 can use fudge factors 660 and 645, respectively, to adjust individual stage quench flow demands, as may be deemed necessary. The fudge factors can be constant values, for example, determined automatically or predetermined by the discharge temperature control circuit 600, or the fudge factors can be configured by an operator to allow manual intervention in the overall automated control process. The fudge factors (e.g., 660 and 645) can be the same or different for different compression stages. The fudge factors can remain the same or change over time. The respective fudge factor can be multiplied by (or otherwise manipulated with) the respective recycle flow demand ratio for a compression stage and the quench flow demand 654 determined by the PID controller 640. The product of the fudge factor, the ratio, and the quench flow demand 654 can be returned as the output (e.g., quench flow demand 672 for compression stage 1, quench flow demand 662 for compression stage n) of the discharge temperature control circuit 700. The output quench flow demand for a compression stage can be passed to a controller (e.g., controller 680, 665) to determine an ultimate quench fluid flow injected into the compression stage.

Figure 7:
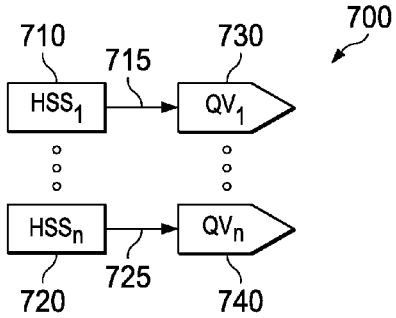
FIG. 7 is a schematic diagram illustrating example function blocks of quench valve controllers.

FIG. 7 is a schematic diagram 700 illustrating example function blocks of quench valve controllers. The quench valve controllers 710 and 720 can be the example quench valve controllers 680 and 665 in FIG. 6, respectively, or the controller 570 in FIG. 5, or other quench valve controllers. The quench valve controllers 710 and 720 can be used to directly control the valve position of an associated quench valve. For example, the quench valve controllers 710 and 720 can be any two of the example quench valve controllers 174*a*, 174*b*, and 174*c* corresponding to the quench valves QV1 124*a*, QV2, 124V, and QV3, 124*c* in FIG. 3, respectively. Each of the quench valve controllers 710 and 720 can receive the inputs, for example, from the suction temperature control circuit 500 and the discharge temperature control circuit 600. For instance, the quench valve controller 710 for compression stage 1 can receive the quench flow demand 565 determined by the suction temperature control circuit 500 and the quench flow demand 672 determined by the discharge temperature control circuit 600 for compression stage 1. Similarly, the quench valve controller 720 for compression stage n can receive the quench flow demand 565 determined by the suction temperature control circuit 500 and the quench flow demand 662 determined by the discharge temperature control circuit 600 for compression stage n. The quench valve controller can determine an ultimate quench flow demand for a compression stage based on the quench flow demand 565 determined by the suction temperature control circuit 500 and the quench flow demand determined by the discharge temperature control circuit 600.

In some instances, there may be no strict need to maintain compressor suction temperatures close to the dew temperature, for example, when a substantial amount of refrigerant to compensate for absence of vaporization in the main chillers are recycled. In some instances, during compressor startup operation the key criterion of sustainable operation is normal operation of the condenser and not exceeding compressor final stage discharge temperature limit. The quench flow demand determined by the discharge temperature control circuit 600 may play a more dominant role as compared to the quench flow demand 565 determined by the suction temperature control circuit 500. For example, the compression system may still operate normally when a suction temperature at a compression stage is above the example temperature setpoint curve 430 in FIG. 4, if the discharge temperature is at or below the discharge temperature limit. In some implementations, to minimize or otherwise reduce the overall cooling demand, and hence reduce the load of the prime mover of the compression system, each of the quench valve controllers 710, 720 can include an HSS to select a larger quench flow demand as between the two demands determined by the suction temperature control circuit 500 and the discharge temperature control circuit 600. In some instances, this can provide a minimum quench flow that is based on either the compressor suction temperature setpoint demand (dew temperature curve) or the discharge temperature set point demand. In some instances, the use of HSS can help guarantee that both the suction temperature and the discharge temperature are at or below their respective setpoints or limits. In some implementations, one or more of the HSSs (e.g., HSS1, HSSn) can also receive respective fudge factors (not shown) that can include, for example, manually determined quench flow demands, default quench flow demand preset by the system, etc. In some instances, the HSSs can select the largest quench flow demand among the received quench flow demands.

In some instances, the controllers 710 and 720 can convert the selected quench flow demands to valve position demands 715 and 725 for the compression stage 1 and n, respectively. The valve position demands 715 and 725 can be sent to the associated quench valves QV1 730 and QVn 740 (e.g., QV1, 124*a*, QV2, 124*b*, and QV3, 124*c* in FIG. 3) to adjust the liquid refrigerant flow injected through the quench valves into the compression stages. In some implementations, the controller can convert a flow demand to a valve position demand based on a linear function or a linearization function (e.g., in case the relationship is not linear). For example, the flow demand can be from 0 to 100% of the rated quench flow per process design requirements. The quench valve can be sized to fully open when the rated quench flow is at 100% while fully closed when the rated quench flow is at 0.

A working example of the refrigeration compression system 300 that includes the suction temperature control circuit 500 and the discharge temperature control circuit 600 is described as follows. An inlet pressure 510 for compression stage n is measured as 27.6 psig (pounds per square inch gauge or pounds per square inch gage, indicating that the pressure is relative to atmospheric pressure). Based on the dew temperature curve (e.g., as shown in FIGS. 2 and 4), a corresponding dew temperature 535 (for 100% propane) can be determined to be, for example, approximately 6.5 (° F.). A setpoint margin can be, for example, 18 (° F.). The temperature setpoint 545 can be computed based on the setpoint margin as 6.5+18=24.5(° F.). If the measured suction temperature 550 at the compression n is 25 (° F.), given the temperature setpoint 545 of 24.5 (° F.), the PID controller 560 can automatically determine an instant quench flow demand 565 to be, for example, 20%, in order to lower the suction temperature 550 to the temperature setpoint 545. In some instances, the output of the PID controller 560 can keep changing (e.g., increasing or decreasing) until the measured suction temperature 550 (i.e., the process variable) equals the temperature setpoint 545. The quench flow demand 565 determined by the suction temperature control circuit 500 is passed into the quench valve controller for the compression stage n (e.g., controller 710 in FIG. 7 for n=1).

On the other hand, for the discharge temperature control circuit 600, the discharge temperature setpoint 652 can be set as, for example, 185 (° F.). Given the discharge temperature 610 being, for example, 200 (° F.), the PID controller 640 can determine the instant quench flow demand 654 to be, for example, 25% to ensure the present discharge temperature 610 stays at or below the discharge temperature setpoint 652. In one scenario, the recycle flow demands 613, . . . , 623 may be 100% (e.g., the anti-surge valves ASV1 615, . . . , ASVn 625 are all fully open) for all compression stages. Thus the maximum recycle flow demand 656 computed by the HSS 635 is 100% and the recycle flow demand ratio is 1 for each compression stage. Assuming the fudge factor 660 is 1, then the quench flow demand 672 for compression stage 1 computed by the math module 670 can be, for example, 25%. In another scenario, the recycle flow demands 613 and 623 may be 100% and 75% for compression stage 1 and compression stage n, n≠1, respectively. Assuming the maximum recycle flow demand 656 computed by the HSS 635 is 100%, the recycle flow demand ratios are 1 for compression stage 1 and 0.75 for compression stage n, respectively. Assuming the fudge factors 660 and 645 for both discharge temperature control circuits are 1, then the quench flow demand 672 for compression stage 1 can be 25% while the quench flow demand 662 for compression stage n can be 18.75%. The quench flow demand 672 of 25% determined by the discharge temperature control circuit 600 can be passed to, for example, the quench valve controller 710 to select an ultimate quench flow demand for the compression stage 1. The quench flow demand 662 of 18.75% determined by the discharge temperature control circuit 600 can be passed to, for example, the quench valve controller 720 to select an ultimate quench flow demand for the compression stage n For compression stage 1, between the quench flow demand 565, 20%, determined by the suction temperature control circuit 500, and the quench flow demand 672, 25%, determined by the discharge temperature control circuit 600, the quench valve controller 710 can select the discharge quench flow demand 25% as the ultimate quench flow demand for compression stage 1. Similarly, for compression stage n, given the quench flow demand 565, 20%, determined by the suction temperature control circuit 500, and the quench flow demand 672, 18.75%, determined by the discharge temperature control circuit 600, the quench valve controller 720 can select the suction quench flow demand 20% as the ultimate quench flow demand for compression stage n. The selected quench flow demands 25% and 20% can be converted to corresponding quench valve position demands and sent, for example, simultaneously to the quench valve QV1 124*a* and QV3 124*c* (for n=3) in FIG. 3, respectively.

In some implementations, one or both outputs of the suction temperature control circuit 500 or the discharge temperature control circuit 600 can be overwritten, disabled, or otherwise manipulated. For example, one of the control circuits 500 and 600 can be disabled so that the ultimate quench flow demand may depend only on the output from the other. As an example, the output from the suction temperature control circuit 500 can be set to be a fixed value (e.g., 0 or a negative number) or another value smaller than the output from the discharge temperature control circuit 600, and vice versa. In some implementations, an offset factor can be used to rewrite the output from one circuit so that that a deselected flow demand always follows slightly behind the selected flow demand to prevent integral windup in a closed direction and for the stable operation of the entire system. For example, if the suction temperature control circuit 500 and the discharge temperature control circuit 600 output the same quench flow demand, x %, an offset factor −a % can be used such that the output of one circuit (e.g., the suction temperature control circuit 500) remains x % while the output of the other circuit (e.g., the discharge temperature control circuit 600) can be rewritten as (x−a) %. In this case, the quench demand from the suction temperature control circuit 500 is selected and the quench demand from the discharge temperature control circuit 600 is deselected. Additional or different techniques can be used, for example, by the quench valve controller 710 and 720, to manipulate the outputs from the suction temperature control circuit 500 and the discharge temperature control circuit 600.

Some embodiments of subject matter and operations described in this specification can be implemented in digital electronic circuitry, or in computer software, firmware, or hardware, including the structures disclosed in this specification and their structural equivalents, or in combinations of one or more of them. Some embodiments of subject matter described in this specification can be implemented as one or more computer programs, i.e., one or more modules of computer program instructions, encoded on computer storage medium for execution by, or to control the operation of, data processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and processors of any kind of digital computer. Generally, a processor will receive instructions and data from a read only memory or a random access memory or both. A computer includes a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD ROM and DVD-ROM disks. The processor and the memory can be supplemented by, or incorporated in, special purpose logic circuitry.

To provide for interaction with a user, operations can be implemented on a computer having a display device (e.g., a monitor, or another type of display device) for displaying information to the user and a keyboard and a pointing device (e.g., a mouse, a trackball, a tablet, a touch sensitive screen, or another type of pointing device) by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

A client and server are generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). The relationship of client and server arises by virtue of computer programs running on the respective computers and having a client-server relationship to each other.

A number of examples have been shown and described; various modifications can be made. While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented separately or in any suitable sub-combination. Accordingly, other implementations are within the scope of the following claims.

The invention claimed is:

1. A refrigerant compression system comprising:

a compressor system having a plurality of compression stages;

a first suction temperature control circuit associated with a first quench valve operable to provide an adjustable flow of quench fluid into a first compression stage, the first suction temperature control circuit operable to:

identify a first temperature setpoint and an inlet temperature of the first compression stage; and determine a first quench flow demand of a quench fluid flow that is injected through the first quench valve into the first compression stage based on the first temperature setpoint and the inlet temperature of the first compression stage;

a second suction temperature control circuit associated with a second quench valve operable to provide an adjustable flow of quench fluid into a second compression stage, the second suction temperature control circuit operable to:

identify a second temperature setpoint and an inlet temperature of the second compression stage; and determine a second quench flow demand of a quench fluid flow that is injected through the second quench valve into the second compression stage based on the second temperature setpoint and the inlet temperature of the second compression stage;

a discharge temperature control circuit for controlling a discharge temperature at an outlet of the plurality of compression stages, the discharge temperature control circuit operable to:

receive information regarding the discharge temperature at the outlet of the plurality of compression stages and a discharge temperature setpoint; and determine a third quench flow demand of the quench fluid flow that is injected through the first quench valve into the first compression stage and a fourth quench flow demand of the quench fluid flow that is injected through the second quench valve into the second compression stage such that the discharge temperature at the outlet of the plurality of compression stages is maintained at or below the discharge temperature setpoint; and a first quench valve controller associated with the first quench valve, the first quench valve controller operable to:

receive the first quench flow demand determined by the first suction temperature control circuit;

receive the third quench flow demand determined by the discharge temperature control circuit; and determine a valve position demand of the first quench valve based on the first quench flow demand and the third quench flow demand; and a second quench valve controller associated with the second quench valve, the second quench valve controller operable to:

receive the second quench flow demand determined by the second suction temperature control circuit;

receive the fourth quench flow demand determined by the discharge temperature control circuit; and determine a valve position demand of the second quench valve based on the second quench flow demand and the fourth quench flow demand.

2. The refrigerant compression system of claim 1, wherein the first suction temperature control circuit is operable to:

receive information regarding a first inlet pressure at the first compression stage; and determine, dynamically, the first temperature setpoint according to a first dew temperature curve based on the first inlet pressure at the first compression stage; and the second suction temperature control circuit is operable to:

receive information regarding a second inlet pressure at the second compression stage; and determine, dynamically, the second temperature setpoint according to a second dew temperature curve based on the second inlet pressure at the second compression stage.

3. The refrigerant compression system of claim 2, wherein the first suction temperature control circuit is operable to receive a first temperature setpoint margin; and wherein the first temperature setpoint is determined according to the first dew temperature curve based on the first inlet pressure at the first compression stage and the first temperature setpoint margin; and the second suction temperature control circuit is operable to receive a second temperature setpoint margin; and wherein the second temperature setpoint is determined according to the second dew temperature curve based on the second inlet pressure at the second compression stage and the second temperature setpoint margin.

4. The refrigerant compression system of claim 1, further comprising:

a first anti-surge valve operable to provide a first recycle fluid flow injected through the first anti-surge valve into the first compression stage;

a second anti-surge valve operable to provide a second recycle fluid flow injected through the second anti-surge valve into the second compression stage; and wherein the discharge temperature control circuit is operable to:

determine the third quench flow demand based on the first recycle fluid flow injected through the first anti-surge valve into the first compression stage; and determine the fourth quench flow demand based on the second recycle fluid flow injected through the second anti-surge valve into the second compression stage.

5. The refrigerant compression system of claim 4, wherein the discharge temperature control circuit comprises a discharge temperature sub-controller operable to:

receive the information regarding the discharge temperature at the outlet of the plurality of compression stages and the discharge temperature setpoint; and determine a fifth quench flow demand based on the discharge temperature at the outlet of the plurality of compression stages and the discharge temperature setpoint; and wherein the discharge temperature control circuit is operable to:

compute a first ratio of the first recycle fluid flow injected into the first compression stage to a maximum recycle fluid flow among recycle fluid flows injected into the plurality of compression stages;

determine the third quench flow demand of the first compression stage based on a product of the fifth quench flow demand and the first ratio;

compute a second ratio of the second recycle fluid flow injected into the second compression stage to the maximum recycle fluid flow among recycle fluid flows injected into the plurality of compression stages; and determine the fourth quench flow demand of the second compression stage based on a product of the fifth quench flow demand and the second ratio.

6. The refrigerant compression system of claim 1, wherein the discharge temperature control circuit is operable to:

receive a first fudge factor and a second fudge factor;

determine the third quench flow demand of the quench fluid flow based on the first fudge factor; and determine the fourth quench flow demand based on the second fudge factor.

7. The refrigerant compression system of claim 1, wherein the first quench valve controller is operable to:

compare the first quench flow demand determined by the first suction temperature control circuit and the third quench flow demand determined by the discharge temperature control circuit; and determine the valve position demand of the first quench valve based on a larger quench flow demand as between the first quench flow demand and the third quench flow demand; and the second quench valve controller is operable to:

compare the second quench flow demand determined by the second suction temperature control circuit and the fourth quench flow demand determined by the discharge temperature control circuit; and determine the valve position demand of the second quench valve based on a larger quench flow demand as between the second quench flow demand and the fourth quench flow demand.

8. A control method for a refrigeration compression system, the refrigeration compression system including a compressor system having a plurality of compression stages, the method comprising:

identifying, by a first suction temperature control circuit, a first temperature setpoint and an inlet temperature of a first compression stage;

determining, by the first suction temperature control circuit, a first quench flow demand of a quench fluid flow that is injected through a first quench valve into the first compression stage based on the first temperature setpoint and the inlet temperature of the first compression stage;

identifying, by a second suction temperature control circuit, a second temperature setpoint and an inlet temperature of a second compression stage;

determining, by the second suction temperature control circuit, a second quench flow demand of a quench fluid flow that is injected through a second quench valve into the second compression stage based on the second temperature setpoint and the inlet temperature of the second compression stage;

receiving, by a discharge temperature control circuit, information regarding a discharge temperature at an outlet of the plurality of compression stages and a discharge temperature setpoint;

determining, by the discharge temperature control circuit, a third quench flow demand of the quench fluid flow that is injected through the first quench valve into the first compression stage and a fourth quench flow demand of the quench fluid flow that is injected through the second quench valve into the second compression stage such that the discharge temperature at the outlet of the plurality of compression stages is maintained at or below the discharge temperature setpoint;

determining, by a first quench valve controller associated with the first quench valve, a valve position demand of the first quench valve based on the first quench flow demand and the third quench flow demand; and determining, by a second quench valve controller associated with the second quench valve, a valve position demand of the second quench valve based on the second quench flow demand and the fourth quench flow demand.

9. The method of claim 8, wherein identifying the first temperature setpoint for the first compression stage comprises:

receiving information regarding a first inlet pressure at the first compression stage; and determining, dynamically, the first temperature setpoint according to a first dew temperature curve given the first inlet pressure at the first compression stage; and identifying the second temperature setpoint for the second compression stage comprises:

receiving information regarding a second inlet pressure at the second compression stage; and determining, dynamically, the second temperature setpoint according to a second dew temperature curve given the second inlet pressure at the second compression stage.

10. The method of claim 9, wherein identifying the first temperature setpoint for the first compression stage further comprises receiving a first temperature setpoint margin; and wherein the first temperature setpoint is determined according to the first dew temperature curve based on the first inlet pressure at the first compression stage and the first temperature setpoint margin; and identifying the second temperature setpoint for the second compression stage comprises receiving a second temperature setpoint margin; and wherein the second temperature setpoint is determined according to the second dew temperature curve based on the second inlet pressure at the second compression stage and the second temperature setpoint margin.

11. The method of claim 8, wherein determining the third quench flow demand comprises determining the third quench flow demand based on a first recycle fluid flow injected through a first anti-surge valve into the first compression stage; and determining the fourth quench flow demand for the second compression stage comprises determining the fourth quench flow demand based on a second recycle fluid flow injected through a second anti-surge valve into the second compression stage.

12. The method of claim 11, wherein determining the third quench flow demand for the first compression stage and the fourth quench flow demand for the second compression stage comprises:

determining a fifth quench flow demand based on the discharge temperature at the outlet of the plurality of compression stages and the discharge temperature setpoint;

computing a first ratio of the first recycle fluid flow injected into the first compression stage to a maximum recycle fluid flow among recycle fluid flows injected into the plurality of compression stages;

determining the third quench flow demand of the first compression stage based on a product of the fifth quench flow demand and the first ratio;

computing a second ratio of the second recycle fluid flow injected into the second compression stage to the maximum recycle fluid flow among recycle fluid flows injected into the plurality of compression stages; and determining the fourth quench flow demand of the second compression stage based on a product of the fifth quench flow demand and the second ratio.

13. The method of claim 8, wherein determining the third quench flow demand for the first compression stage comprises:

receiving a first fudge factor and a second fudge factor;

determining the third quench flow demand of the quench fluid flow based on the first fudge factor; and determining the fourth quench flow demand based on the second fudge factor.

14. The method of claim 8, wherein determining the valve position demand of the first quench valve and the valve position demand of the second quench valve comprises:

comparing the first quench flow demand determined by the first suction temperature control circuit and the third quench flow demand determined by the discharge temperature control circuit; and determining the valve position demand of the first quench valve based on a larger quench flow demand as between the first quench flow demand and the third quench flow demand;

comparing the second quench flow demand determined by the second suction temperature control circuit and the fourth quench flow demand determined by the discharge temperature control circuit; and determining the valve position demand of the second quench valve based on a larger quench flow demand as between the second quench flow demand and the fourth quench flow demand.

15. A non-transitory computer-readable medium storing instructions that, when executed by data processing apparatus, perform operations for controlling a refrigeration compression system that includes a compressor system having a plurality of compression stages, the operations comprising:

identifying, by a first suction temperature control circuit, a first temperature setpoint and an inlet temperature of a first compression stage;

determining, by the first suction temperature control circuit, a first quench flow demand of a quench fluid flow that is injected through a first quench valve into the first compression stage based on the first temperature setpoint and the inlet temperature of the first compression stage;

identifying, by a second suction temperature control circuit, a second temperature setpoint and an inlet temperature of a second compression stage;

determining, by the second suction temperature control circuit, a second quench flow demand of a quench fluid flow that is injected through a second quench valve into the second compression stage based on the second temperature setpoint and the inlet temperature of the second compression stage;

receiving, by a discharge temperature control circuit, information regarding a discharge temperature at an outlet of the plurality of compression stages and a discharge temperature setpoint;

determining, by the discharge temperature control circuit, a third quench flow demand of the quench fluid flow that is injected through the first quench valve into the first compression stage and a fourth quench flow demand of the quench fluid flow that is injected through the second quench valve into the second compression stage such that the discharge temperature at the outlet of the plurality of compression stages is maintained at or below the discharge temperature setpoint;

determining, by a first quench valve controller associated with the first quench valve, a valve position demand of the first quench valve based on the first quench flow demand and the third quench flow demand; and determining, by a second quench valve controller associated with the second quench valve, a valve position demand of the second quench valve based on the second quench flow demand and the fourth quench flow demand.

16. The non-transitory computer-readable medium of claim 15, wherein identifying the first temperature setpoint for the first compression stage comprises:

receiving information regarding a first inlet pressure at the first compression stage; and determining, dynamically, the first temperature setpoint according to a first dew temperature curve given the first inlet pressure at the first compression stage; and identifying the second temperature setpoint for the second compression stage comprises:

receiving information regarding a second inlet pressure at the second compression stage; and determining, dynamically, the second temperature setpoint according to a second dew temperature curve given the second inlet pressure at the second compression stage.

17. The non-transitory computer-readable medium of claim 15, wherein determining the third quench flow demand comprises determining the third quench flow demand based on a first recycle fluid flow injected through a first anti-surge valve into the first compression stage; and determining the fourth quench flow demand for the second compression stage comprises determining the fourth quench flow demand based on a second recycle fluid flow injected through a second anti-surge valve into the second compression stage.

18. The non-transitory computer-readable medium of claim 17, wherein determining the third quench flow demand for the first compression stage and the fourth quench flow demand for the second compression stage comprises:

determining a fifth quench flow demand based on the discharge temperature at the outlet of the plurality of compression stages and the discharge temperature setpoint;

computing a first ratio of the first recycle fluid flow injected into the first compression stage to a maximum recycle fluid flow among recycle fluid flows injected into the plurality of compression stages;

determining the third quench flow demand of the first compression stage based on a product of the fifth quench flow demand and the first ratio;

computing a second ratio of the second recycle fluid flow injected into the second compression stage to the maximum recycle fluid flow among recycle fluid flows injected into the plurality of compression stages; and determining the fourth quench flow demand of the second compression stage based on a product of the fifth quench flow demand and the second ratio.

19. The non-transitory computer-readable medium of claim 15, wherein determining the third quench flow demand for the first compression stage comprises:

receiving a first fudge factor and a second fudge factor;

determining the third quench flow demand of the quench fluid flow based on the first fudge factor; and determining the fourth quench flow demand based on the second fudge factor.

20. The non-transitory computer-readable medium of claim 15, wherein determining the valve position demand of the first quench valve and the valve position of the second quench valve comprises:

comparing the first quench flow demand determined by the first suction temperature control circuit and the third quench flow demand determined by the discharge temperature control circuit; and determining the valve position demand of the first quench valve based on a larger quench flow demand as between the first quench flow demand and the third quench flow demand;

comparing the second quench flow demand determined by the second suction temperature control circuit and the fourth quench flow demand determined by the discharge temperature control circuit; and determining the valve position demand of the second quench valve based on a larger quench flow demand as between the second quench flow demand and the fourth quench flow demand.

* * * * *